US009933746B2

(12) United States Patent
Fukuda et al.

(10) Patent No.: US 9,933,746 B2
(45) Date of Patent: Apr. 3, 2018

(54) IMAGE FORMING APPARATUS

(71) Applicant: CANON KABUSHIKI KAISHA, Tokyo (JP)

(72) Inventors: Tadashi Fukuda, Tokyo (JP); Yasuki Kamimori, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/238,565

(22) Filed: Aug. 16, 2016

(65) Prior Publication Data

US 2017/0052500 A1 Feb. 23, 2017

(30) Foreign Application Priority Data

Aug. 20, 2015 (JP) ..... 2015-162990

(51) Int. Cl.
*G03G 21/00* (2006.01)
*G03G 15/00* (2006.01)
*G03G 5/00* (2006.01)

(52) U.S. Cl.
CPC ..... *G03G 21/0035* (2013.01); *G03G 5/00* (2013.01); *G03G 15/751* (2013.01); *G03G 21/0011* (2013.01); *G03G 21/0076* (2013.01)

(58) Field of Classification Search
CPC ..... G03G 21/0035; G03G 21/0076; G03G 21/0011; G03G 5/00; G03G 15/751
USPC ..... 399/349
See application file for complete search history.

(56) References Cited

U.S. PATENT DOCUMENTS

2006/0222425 A1* 10/2006 Facci ..... G03G 21/0035 399/353
2009/0297972 A1* 12/2009 Sakimura ..... G03G 5/14704 430/66
2010/0239317 A1* 9/2010 Motomura ..... G03G 5/047 399/159

FOREIGN PATENT DOCUMENTS

JP 2005-43806 A 2/2005
JP 2005-208325 A 8/2005
JP 2008-026780 A 2/2008
JP 2009-300860 A 12/2009

* cited by examiner

*Primary Examiner* — Billy Lactaoen
(74) *Attorney, Agent, or Firm* — Canon U.S.A. Inc., IP Division

(57) ABSTRACT

An elastic deformation rate of a photoconductor, an additive amount of inorganic fine particles, and a rotary member are set to satisfy a relation of $0.6 \leq (D/(A \times B/C))/(1+E/20) \leq 0.82$, where A is a thickness of fibers of a brush, B is a bristle density of the fibers of the brush, C is a length of the fibers of the brush, D is an elastic deformation rate obtained from a hardness test conducted using a Vickers diamond pyramid indenter at a temperature of 23° C. and a humidity of 50%, and E is the additive amount of the inorganic fine particles relative to 100 parts by mass of toner particles.

26 Claims, 9 Drawing Sheets

IMAGE FORMING APPARATUS

BACKGROUND OF THE INVENTION

Field of the Invention

The present invention relates to an electrophotographic image forming apparatus.

Description of the Related Art

Conventionally, in the electrophotographic image forming method, a surface of an image bearing member is charged, the charged surface of the image bearing member is irradiated with light to form an electrostatic latent image, the electrostatic latent image is developed with a coloring toner to form a visible image, the toner image is transferred to a transfer sheet, and the transferred toner image is fixed with a heat roller. After the transfer process, an external additive, an untransferred toner, and a discharge product remaining on the surface of the image bearing member need to be removed by a cleaning unit prior to a next image forming process. The cleaning unit for removing, for example, the transfer residual toner, employs various methods, such as a method using a fur brush or a magnetic brush, and a method using an elastic cleaning blade. Since using of the cleaning blade which rubs the image bearing member to scrape the toner from the image bearing member is simple and inexpensive, it is generally used.

With the recent acceleration of operation speed of image forming apparatuses and enhancement of image quality, the shape of toner particles used by the image forming apparatus becomes more spherical. This causes difficulty in cleaning the toner by only the cleaning blade. Thus, a cleaning auxiliary unit for supporting removal of transfer residual toner is provided. For example, a fur brush that contacts the image bearing member is arranged in front of the cleaning blade, so that transfer residual toner before reaching the cleaning blade is removed by the fur brush. The pre-cleaning operation performed by the fur brush reduces a load of the cleaning blade and enhances cleanability. Such a technique is discussed in Japanese Patent Application Laid-Open No. 2009-300860, for example.

In Japanese Patent Application Laid-Open No. 2009-300860, a brush roller to which a bias can be applied is arranged on an upstream side of a cleaning blade to support a cleaning operation. Moreover, enhancement of cleanability is discussed. A bristle density of brush or a resistance value of brush is defined to increase a contact probability between the brush roller and toner, so that the cleanability is enhanced.

The fur brush has not only a function of cleaning a surface layer of a photoconductor, and also a function of grinding the surface layer of the photoconductor. In Japanese Patent Application Laid-Open No. 2009-300860, however, grinding of the surface layer of the photoconductor and an abrasion amount of the surface layer of the photoconductor are not precisely defined. The abrasion amount of the surface layer of the photoconductor varies depending on a hardness of the surface layer of the photoconductor and a bristle condition of the fur brush.

Recently, a configuration for increasing a hardness of a surface layer of a photoconductor is employed to prolong the lifetime of the photoconductor. If the surface layer of the photoconductor is hard, a grinding amount or an abrasion amount of the surface layer of the photoconductor tends to be reduced. Consequently, discharge products are accumulated. This degrades a surface property of the photoconductor, and thus the lifetime of the photoconductor cannot be sufficiently prolonged.

SUMMARY OF THE INVENTION

The present invention is directed to an image forming apparatus capable of suppressing accumulation of discharge products to prolong the lifespan of an photoconductor.

According to an aspect of the present invention, an image forming apparatus includes a rotatable photoconductor configured to bear a toner image, an image forming unit configured to form the toner image on the photoconductor with toner, the toner comprising inorganic fine particles as an external additive, a cleaning blade configured to clean toner remaining on the photoconductor after the toner image is transferred, and a brush that is disposed on an upstream side of the cleaning blade in a rotation direction of the photoconductor, the brush including polyester, fibers, and a conductive material, wherein an elastic deformation rate of the photoconductor, an additive amount of the inorganic fine particles, and the fibers of the brush satisfy the following relationship:

$$0.6 \leq (D/(A \times B/C))/(1+E/10) \leq 0.82,$$

where A is a thickness of the fibers of the brush, B is a bristle density of the fibers of the brush, C is a length of the fibers of the brush, D is an elastic deformation rate obtained from a hardness test conducted using a Vickers diamond pyramid indenter at a temperature of 23° C. and a humidity of 50%, and E is the additive amount of the inorganic fine particles relative to 100 parts by mass of toner particles.

Further features of the present invention will become apparent from the following description of exemplary embodiments with reference to the attached drawings.

DESCRIPTION OF THE EMBODIMENTS

Hereinafter, an image forming apparatus according to exemplary embodiments of the present invention is described with reference to the drawings.

[Brief Description of Image Forming Apparatus]

Figure 1:
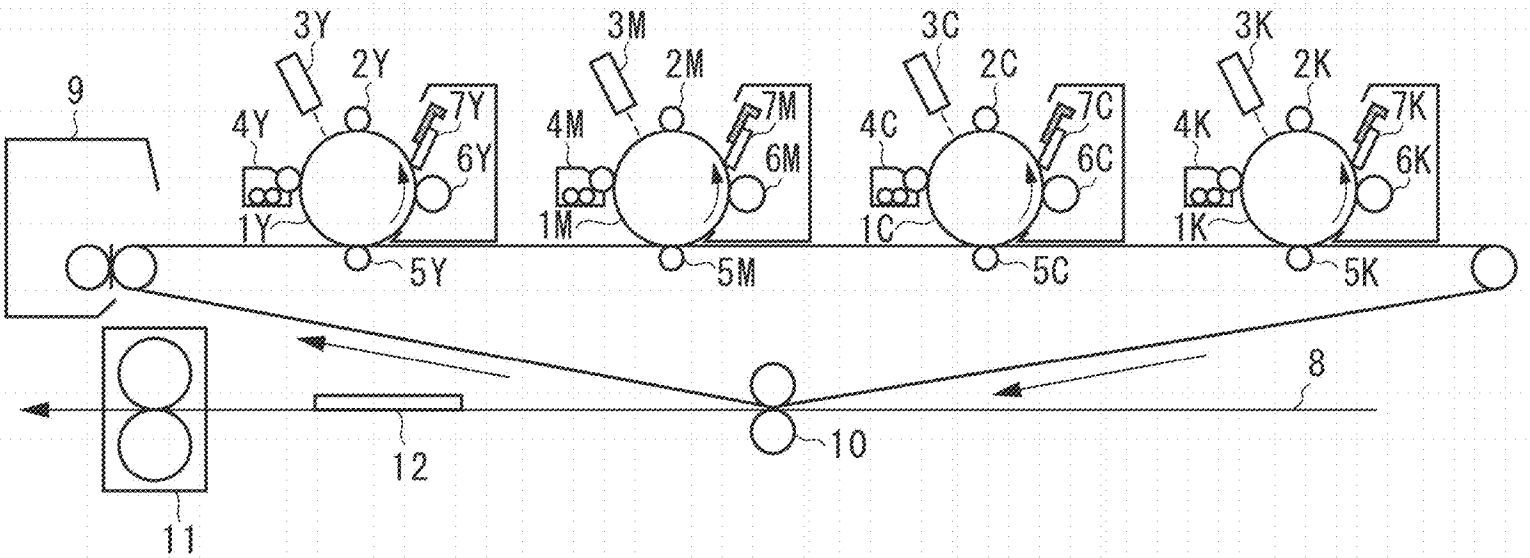
FIG. 1 is a schematic diagram illustrating an image forming apparatus according to an exemplary embodiment of the present invention.

FIG. 1 is a schematic diagram illustrating an image forming apparatus according to an exemplary embodiment of the present invention. The image forming apparatus includes image forming units for respective colors of yellow (Y), magenta (M), cyan (C), and black (K). Each of the image forming units includes a photoconductor 1. Around the photoconductor 1, a charging unit 2, an exposure unit 3, a development unit 4, a primary transfer unit 5, a fur brush 6, and a cleaning blade 7 are arranged. The charging unit 2, the exposure unit 3, the development unit 4, and the primary transfer unit 5 serve as image forming elements, and the fur brush 6 of a brush-type rotary member and the cleaning blade 7 serve as cleaning elements. A toner image developed on the photoconductor 1 is transferred to an intermediate transfer belt 8 by the primary transfer unit 5. The toner transferred to the intermediate transfer belt 8 is transferred to a recording medium 12 by a secondary transfer unit, and then fixed on the recording medium 12 with heat and pressure applied by a fixing unit 11. After the secondary transfer, a transfer residual toner remaining on the intermediate transfer belt 8 is removed from the intermediate transfer belt 8 by an intermediate transfer belt cleaning unit 9.

(Toner)

Toner is frictionally charged with a negative polarity by rubbing against a magnetic carrier. In the present exemplary embodiment, the carrier is made of a material including ferrite, and has an average particle diameter of approximately 40 μm. The toner is prepared by comminuting a mixture of a pigment, a wax component, and a resin binder including mainly polyester, and has an average particle diameter of approximately 6 μm. A plurality of types of external additive components is added to a surface layer of the toner for the purposes of electric charge control, fluidity addition, and transferability enhancement. The external additive components include silica and titanium oxide, and also inorganic fine particles of which primary particles have an average particle diameter of 30 nm to 300 nm, and which have a cubic particle shape and/or a cuboid particle shape and a perovskite structure. In the present exemplary embodiment, strontium titanate fine powder is added as the inorganic fine particles having the perovskite structure.

The external additive in an amount of 0.05 to 2.00 parts by mass is preferably added to 100 parts by mass of toner particles. In the present exemplary embodiment, strontium titanate fine powder in an amount of 0.5 parts by mass of is added. The strontium titanate used as inorganic fine particles is preferably not sintered.

The strontium titanate fine powder has a cubic particle shape and/or a cuboid particle shape. By being supplied to the cleaning blade 7 of the photoconductor 1 which will be described below, the strontium titanate fine powder has a function of grinding a surface of the photoconductor 1. The inorganic fine particles are made of strontium titanate. However, the inorganic fine particles can be, for example, a barium titanate fine powder and a calcium titanate fine powder.

The inorganic fine powder of the perovskite structure used in the present exemplary embodiment includes primary particles having an average particle diameter of 30 nm to 300 nm. The primary particles preferably have an average particle diameter of 40 nm to 300 nm, and more preferably 40 nm to 250 nm. If the average particle diameter is less than 30 nm, a grinding effect of the particles in the cleaning blade 7 of the photoconductor 1 is not sufficient. If the average particle diameter exceeds 300 nm, the grinding effect is more than sufficient. This generates flaws on the surface of the photoconductor 1. Thus, such particles are not appropriate.

Moreover, the inorganic fine powder having the perovskite structure is not necessarily present as a primary particle on a toner particle surface. The inorganic fine powder can be present as an aggregate. In such a case, if a content rate of the aggregate having a particle diameter of 600 nm or more is 1% by number of units or less, a good result can be obtained. In a case where a content rate of particles and the aggregate having a particle diameter of 600 nm or more exceeds 1% by number of units, even if a primary particle diameter is less than 300 nm, flaws are generated on the surface layer of the photoconductor. Hence, such particles are not appropriate.

An external additive formulation is set such that toner adhering to portions, of the photoconductor 1, having potential by an exposure unit has an average charge amount of approximately −30 μC/g to 35 μC/g. If an average charge amount of the toner is excessively high, cleanability in the fur brush 6 and the cleaning blade 7 which will be described below is degraded. On the other hand, if an average charge amount of the toner is excessively low, toner scattering worsens in the fur brush 6 and the cleaning blade 7. Accordingly, an average charge amount needs to be adjusted from a cleanability standpoint.

Figure 4:
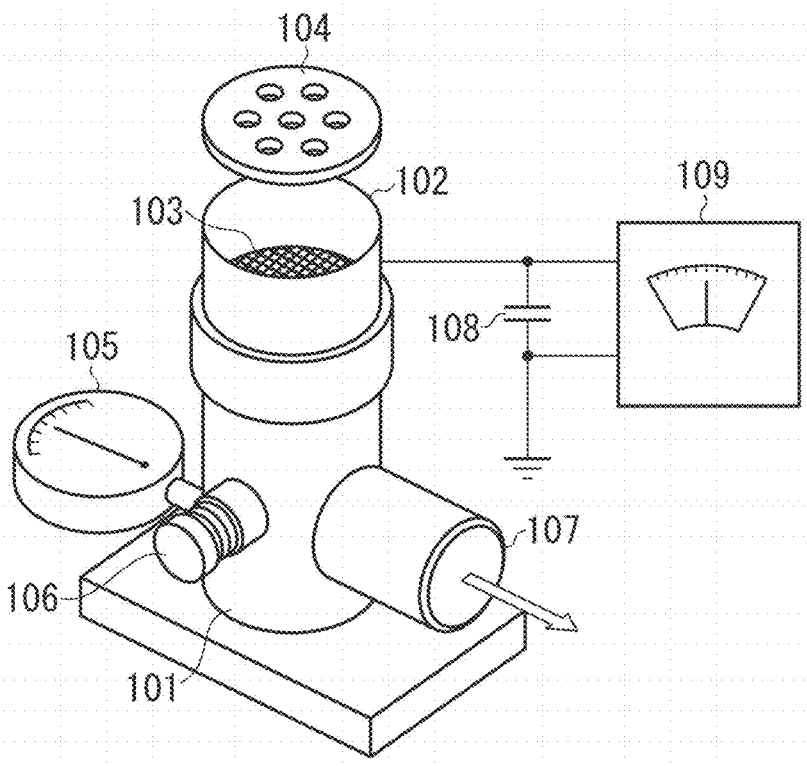
FIG. 4 is a diagram illustrating a charge amount measurement device according to a first exemplary embodiment of the present invention.

A method for measuring a charge amount is described as follows. In the environment with a temperature of 23° C. and a relative humidity of 60%, a mixture in which 0.1 g of a sample to be measured is added to 9.9 g of iron powder (DSP138, manufactured by DOWA IP Creation Co., Ltd.) is inserted into a polyethylene bottle having a capacity of 50 ml, and the bottle containing the mixture is shaken for 100 times. Next, approximately 0.5 g of the mixture is inserted into a measurement container 102 made of metal, and a cover 104 made of metal is placed on the measurement container 102. Herein, a mass of the measurement container 102 as a whole is set to a weight of W1 (g). As illustrated in FIG. 4, the measurement container 102 includes a metal mesh screen 103 on the bottom thereof, the screen 103 having an aperture of 32 μm. Next, in a suction device (a portion that contacts the measurement container 102 is at least an insulator), air is suctioned from a suction port 107, and an air quantity adjusting valve 106 is adjusted to set a pressure of a vacuum gage 105 to 250 mmAq. In this state, the suction is performed for 2 minutes to remove developer. Herein, a potential of an electrometer 109 is V (voltage). Herein, a capacitor 108 has a capacity of C (μF). After the suction, a mass of the measurement device as a whole is set to a weight of W2 (g). A frictional charge amount (mC/kg) of such developer is calculated by the following expression:

$$\text{Frictional charge amount}=CV/(W1-W2).$$

(Photoconductor)

In the exemplary embodiment of the present invention, the photoconductor 1 is an organic photoconductor (OPC) drum with negative chargeability, and has an axial length of 360 mm and an outside diameter of 84 mm. The photoconductor 1 includes a photoconductive layer on a conductive base member. The photoconductive layer includes a photoconduction layer having an organic photoconduction component as a main component. Generally, the OPC includes a metal base member serving as a conductive base member on which a charge generation layer, a charge transport layer, and a surface protecting layer made of organic materials are laminated. For example, materials discussed in Japanese Patent Application Laid-Open No. 2005-43806 are used to form such layers. In the present exemplary embodiment, the top surface layer of the photoconductor 1 is hardened by, for example, an electron beam irradiation apparatus (EC150/45/40 mA, manufactured by Iwasaki Electric Co., Ltd.).

The surface of the photoconductor 1 hardened by the electron beam preferably has an elastic deformation rate of 40% or more and 65% or less. It is more preferably 45% or more, and yet more preferably 50% or more. Moreover, the surface of the photoconductor 1 preferably has a universal hardness (HU) of 150 $N/mm^2$ or more and 220 $N/mm^2$ or less.

The photoconductor 1 is rotated in a direction indicated by an arrow shown in FIG. 1, normally at a process speed (a circumferential speed) of 400 mm/s by a driving device (not illustrated).

Herein, the elastic deformation rate and the universal hardness (HU) of the surface of the photoconductor 1 are measured values acquired by a hardness test, using a micro hardness measurement device Fischerscope H100V (manufactured by Fischer), performed in the environment with a temperature of 23° C. and a relative humidity of 50%. The Fischerscope H100V allows an indenter to contact a measurement target (a circumferential surface of the photoconductor 1), and continuously applies a load to the indenter to determine a continuous hardness by directly reading an indentation depth under the load. As for the indenter, a Vickers diamond pyramid indenter having a face-to-face angle of 136° is used, and the indenter is pressed against the circumferential surface of the photoconductor 1. A load (a final load) that is applied at the end when a load is continuously applied to the indenter is 2 mN, and a time (a retention time) for which application of the final load of 2 mN to the indenter is retained is 0.1 second. Moreover, the number of measurement points are set to 273 points.

Figure 6:
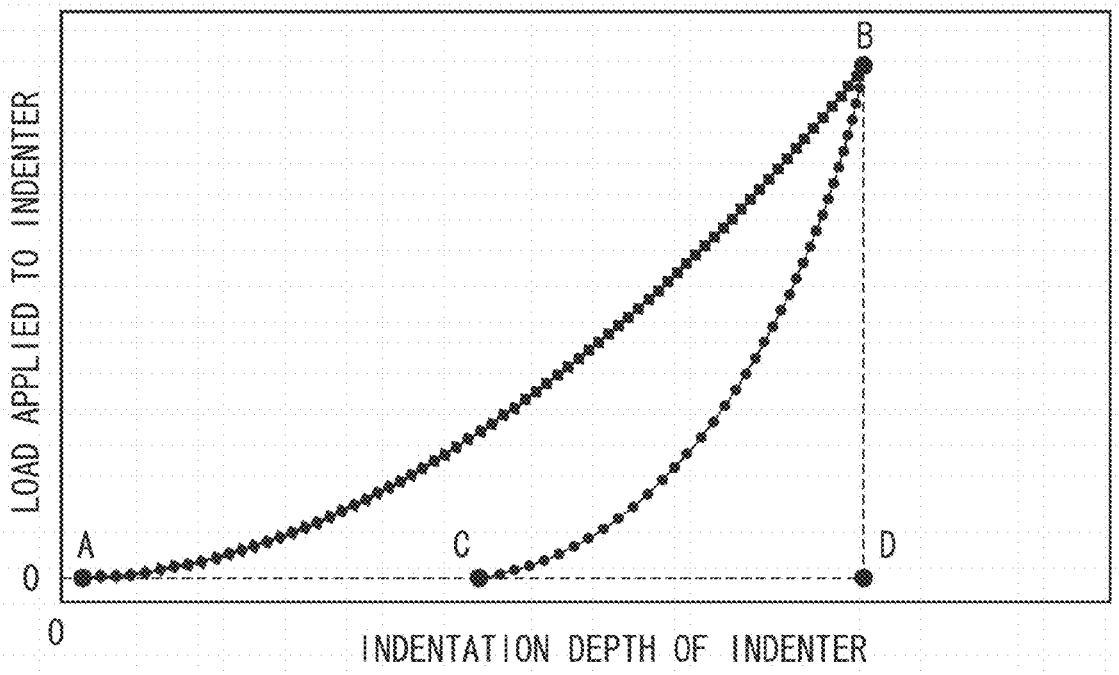
FIG. 6 is a schematic diagram illustrating an output chart of Fischerscope H100V (manufactured by Fischer).
Figure 7:
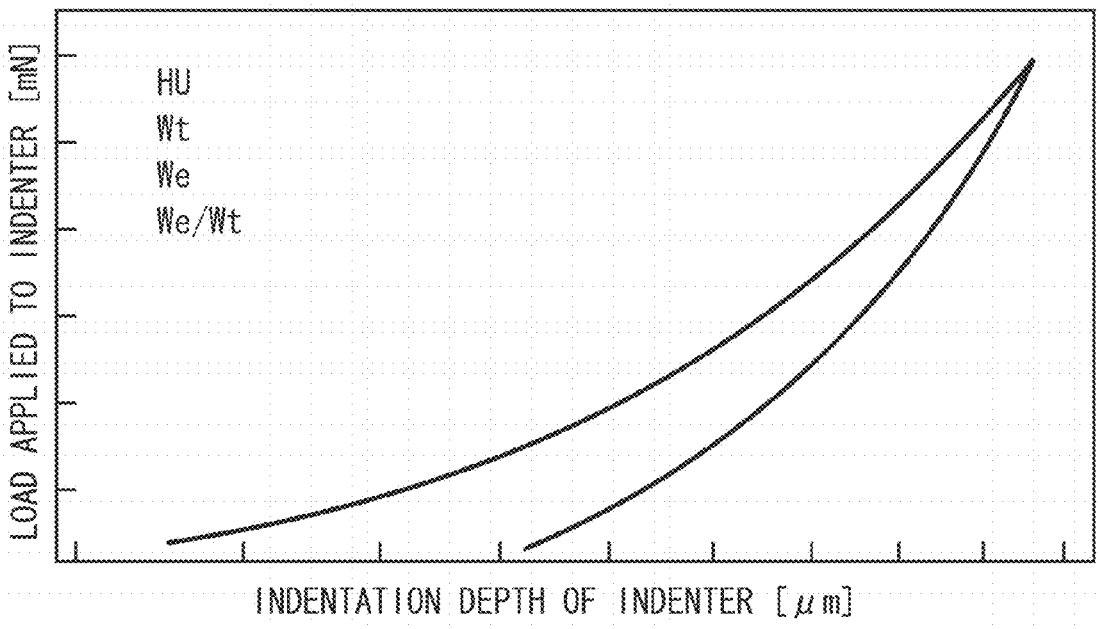
FIG. 7 is a diagram illustrating an example of an output chart of Fischerscope H100V (manufactured by Fischer).

FIG. 6 is a schematic diagram illustrating an output chart of Fischerscope H100V (manufactured by Fischer). FIG. 7 is a diagram illustrating an example of an output chart of Fischerscope H100V (manufactured by Fischer) when the photoconductor 1 of the exemplary embodiment is used as a measurement target. In each of FIGS. 6 and 7, a vertical axis indicates a load F (mN) applied to an indenter, whereas a horizontal axis indicates an indentation depth h (μm) of the indenter. FIG. 6 indicates a result acquired when a load applied to the indenter is gradually increased to the maximum (from A to B) and then is gradually reduced (from B to C). FIG. 7 indicates a result acquired when a load applied to the indenter is gradually increased to a final load of 2 mN, and then is gradually reduced.

Herein, a universal hardness (HU) can be determined using the following Expression (1) below based on the indentation depth of the indenter when the final load of 2 mN is applied to the indenter:

$$HU=Ff(N)/Sf(\mathrm{mm}^2) \quad (1),$$

where HU is a universal hardness, Ff is a final load, and Sf is a surface area of an indented portion of the indenter when the final load is applied.

Moreover, an elastic deformation rate can be determined from a workload (an energy) used by the indenter with respect to the measurement target (the circumferential surface of the photoconductor 1), that is, an elastic deformation rate can be determined from a change in energy due to fluctuations in the load of the indenter with respect to the measurement target (the circumferential surface of the photoconductor 1). Particularly, the elastic deformation rate is a value acquired by dividing an elastic deformation workload We by the entire workload Wt (i.e., We/Wt). The entire workload Wt represents an area enclosed by A-B-D-A shown in FIG. 6, whereas the elastic deformation workload We represents an area enclosed by C-B-D-C shown in FIG. 6.

(Charging Unit)

In the present exemplary embodiment, the charging unit 2 is a corona charging device that includes a discharge electrode and a grid electrode. The corona charging device applies a high voltage to the discharge electrode to uniformly charge the photoconductor 1 by using a discharge phenomenon. In the present exemplary embodiment, an electric current of −1000 μA and a voltage of −600 V are respectively applied to the discharge electrode and the grid electrode, so that a surface potential of the photoconductor 1 being rotated is uniformly charged with approximately −500 V. The charging potential has a negative polarity, and the photoconductor 1 is negatively charged. The charging potential changes with a development bias value according to an environment or a state of the image forming apparatus. In the present exemplary embodiment, the corona charging device is used. However, other configurations may be employed. For example, a contact-type charging roller can be used to charge the photoconductor 1.

(Exposure Unit)

The exposure unit 3 includes a semiconductor laser for irradiating the surface of the photoconductor 1 uniformly charged by the charging unit 2 with laser light based on image information. An exposure potential provided by the laser light is −200 V. Although the present exemplary embodiment is described using an example case in which the semiconductor laser is used, another configuration including, for example, a light emitting diode (LED) can be used.

(Development Unit)

The development unit 4 includes a developer container and a developing sleeve. The developer container stores a two-component developer that is a mixture of a non-magnetic toner and a magnetic carrier. The developing sleeve is rotatably arranged in an opening of the developer container. In the present exemplary embodiment, the developing sleeve has an axial length of 325 mm. The developing sleeve has a function of magnetically retaining the developer inside the developer container by using a magnet arranged thereinside and conveying such developer to a developing portion that is a gap portion formed with the photoconductor 1. The developing sleeve is connected to a high voltage power source for applying a development bias that is superimposition of a direct current voltage (−400V) and an alternating current voltage (Vpp is 1600 V). The use of such a development bias allows toner to adhere to an electrostatic latent image, so that a development process is performed. A setting value of the development bias is one example. The development bias is set to an adjusted value as needed according to a charging potential or an exposure potential of the photoconductor 1.

(Intermediate Transfer Belt)

The intermediate transfer belt 8 is an endless belt, and includes three layers of a resin layer, an elastic layer, and a surface layer arranged in order from a backside thereof. The resin layer is made of a resin material, such as polyimide and polycarbonate, and has a thickness of 70 μm to 100 μm. The elastic layer is made of an elastic material, such as urethane rubber and chloroprene rubber, and has a thickness of 200 μm to 250 μm.

Moreover, a material for the surface layer needs to be able to weaken adhesion force of the toner to a surface of the intermediate transfer belt 8 to enhance secondary transferability. For example, one type of resin material, such as polyurethane, polyester, and epoxy resin, or at least two types of materials among elastic materials (elastic rubber, elastomer) and elastic materials, such as butyl rubber, are used to reduce a surface energy and enhance lubricity. For example, one type or at least two types of powder or particles, such as fluorine resin, or powder or particles, such as fluorine resin, having different particle diameters can be dispersed so as to be used. Such a surface layer preferably has a thickness of 5 μm to 10 μm. In the present exemplary embodiment, a resistance value adjustment conductive agent, such as carbon black is added to the intermediate transfer belt 8, and the intermediate transfer belt 8 has a volume resistivity of 1E+8 Ω·cm to 1E+14 Ω·cm.

The primary transfer unit 5 includes a metal shaft in which a roller molded from epichlorhydrin rubber having an adjusted electric resistance is used. The primary transfer unit 5 is pressed toward the photoconductor 1 with a predetermined pressure. When a transfer operation is performed, the primary transfer unit 5 applies a transfer bias to transfer a toner image from the photoconductor 1 to the intermediate transfer belt 8.

(Cleaning Unit)

Figure 2:
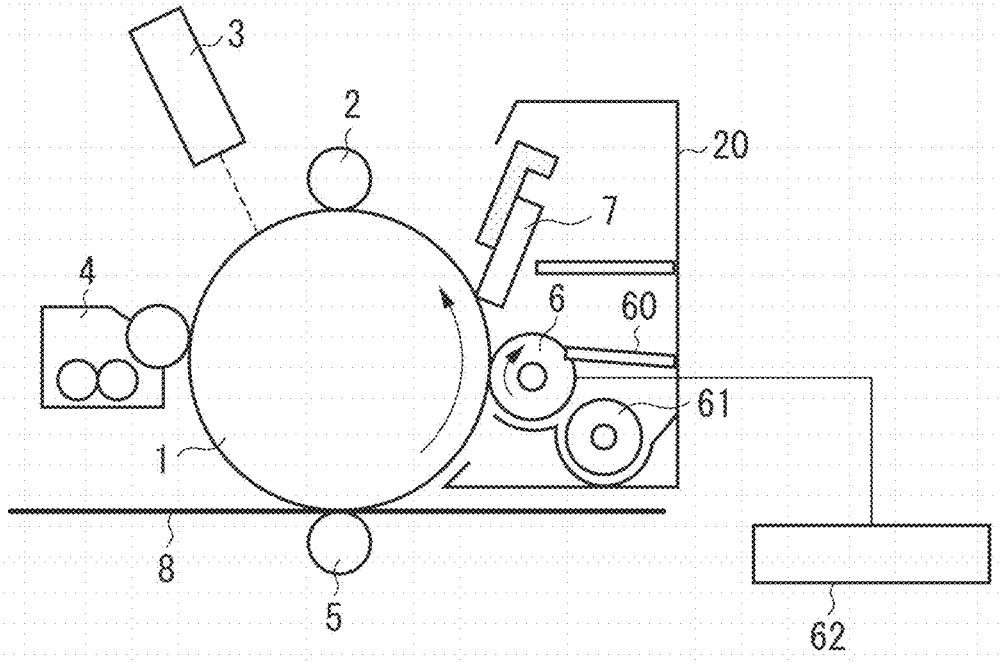
FIG. 2 is a sectional view illustrating a cleaning unit in detail according to the exemplary embodiment.

FIG. 2 is a sectional view illustrating a cleaning unit in detail. The cleaning unit includes a housing 20 and the fur brush 6 serving as a rotary member (a toner scraping unit and an image bearing member grinding unit). Moreover, the cleaning unit includes the cleaning blade 7 on a downstream side of the fur brush 6 in a rotation direction of the photoconductor 1. The cleaning blade 7 contacts the surface of the photoconductor 1. The fur brush 6 is arranged to have an invasion amount of 0.5 mm with respect to the photoconductor 1. The fur brush 6 is rotated while contacting the surface layer of the photoconductor 1.

After transfer of a toner image, residue, such as a transfer residual toner remaining on the surface of the photoconductor 1, is roughly rubbed by the fur brush 6 so that adhesion force of the residue to the photoconductor 1 weaken. Then, the residue is removed from the surface of the photoconductor 1 by the cleaning blade 7. The residue, such as the transfer residual toner removed from the surface of the photoconductor 1, is temporarily retained by the fur brush 6. Subsequently, with the rotation of the fur brush 6, the residue is conveyed to a position in which a scraper 60 contacts a circumferential surface of the fur brush 6. Then, the residue, such as the transfer residual toner, is separated from the fur brush 6 by repulsive force of fiber of the fur brush 6 elastically deformed by the contact of the fur brush 6 with the scraper 60, and falls near a conveyance spiral 61. After falling near the conveyance spiral 61, the residue, such as the transfer residual toner, is conveyed in an axial direction of the photoconductor 1 by the conveyance spiral 61 extending in a rotational axial direction of the photoconductor 1. Then, the residue is collected by a toner collection container via a collection toner conveyance path. The fur brush 6 and the scraper 60 are arranged with an invasion amount of 0.1 mm, and the residue, such as the toner on the fur brush 6, is scraped by the scraper 60.

(Cleaning Blade)

The cleaning blade 7 is made of urethane rubber, and has a length of 340 mm in an axial direction of the photoconductor 1. The cleaning blade 7 is in contact with the photoconductor 1 with a predetermined pressing force. The pressing force is preferably in a range of 600 gf 1600 gf. In the present exemplary embodiment, the pressing force is 1150 gf. Moreover, a blade contact angle is preferably between 20° and 30°. In the present exemplary embodiment, the blade contact angle is 27°. Preferably, requirement properties of the cleaning blade 7 include a hardness (IRHD) of 60° or more and 85° or less, a modulus of repulsion elasticity of 15% to 60% in the environment with a temperature of 25° C., an elongation at break of 300% or less in a tensile test, a Young's modulus of 50 kg/cm$^2$ to 200 kg/cm$^2$, and a 100% modulus in a range of 4.0 MPa to 9.0 MPa. More preferably, a hardness (IRHD) is 70° or more and 80° or less, an elongation at break is 250% or less in a tensile test, and a modulus of repulsion elasticity is 15% or more and 35% or less in the environment with a temperature of 25° C. A measurement method for each of the requirement properties is described as follows. A hardness (IRHD) of a produced cleaning blade is measured according to Japanese Industrial Standards (JIS) K 6253 by using a hardness meter (manufactured by H.W. Wallace & Co., Ltd.). A 100% modulus of the produced cleaning blade is measured according to JIS K 6251 by using a tensile testing machine (UNITRON TS-3013 manufactured by Ueshima Seisakusho Co., Ltd.). Moreover, an elongation at break in a tensile test of the produced cleaning blade is measured according to JIS K 6251 by using a tensile testing machine (UNITRON TS-3013, manufactured by Ueshima Seisakusho Co., Ltd.). A modulus of repulsion elasticity of the produced cleaning blade is measured according to JIS K 6255 by using a Lupke pendulum type resilience testing machine (manufactured by Ueshima Seisakusho Co., Ltd.) in the environment with a temperature of 25° C.

(Fur Brush)

The fur brush 6 positioned on an upstream side of the cleaning blade 7 in the rotation direction of the photoconductor 1 is described. The fur brush 6 as a rotary member includes fiber implanted in a rotary shaft thereof. The fur brush 6 is produced by wrapping fiber-implanted cloth around the metal rotary shaft having a diameter of 12 mm. In the fur brush 6, the fiber in which polyester-made single fibers having a thickness of 10 denier are bundled is implanted in a base material with a bristle density of 30 kF/inch$^2$ (a bristle density per single fiber).

The fur brush as a whole has an outside diameter of 20.4 mm, and the brush fiber has a length of 4.2 mm that is determined by subtracting a cored-bar diameter of 12 mm from the outside diameter. Accordingly, the brush fiber length is determined by a difference between a diameter of the cored bar and an outside diameter of the fur brush unless otherwise noted.

Figure 5A:
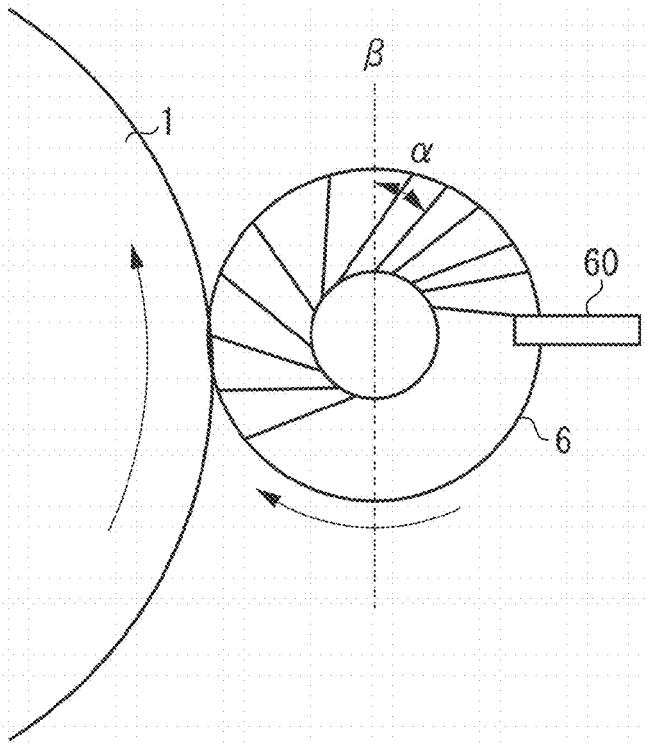
FIGS. 5A and 5B are enlarged views each illustrating an example of the fur brush fiber according to the first exemplary embodiment.
Figure 5B:
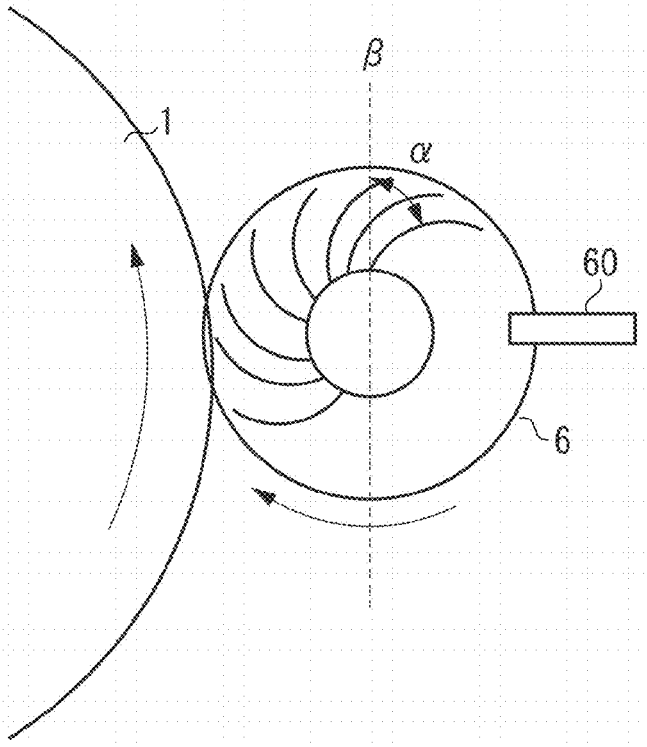

FIGS. 5A and 5B are Enlarged Views Each illustrating a fiber state of the fur brush 6. As can be seen in each of FIGS. 5A and 5B, the brush fiber of the fur brush 6 is not implanted perpendicular to the cored bar. The brush fiber of the fur brush 6 is implanted in a state of lying at an angle α with respect to a perpendicular line β, passing through the center of the cored bar. As described above, the brush fiber length is determined from the outside diameter of the fur brush and the diameter of the cored bar. However, in practice, brush fiber lies. In practice, brush fiber length is longer than the brush fiber length determined from the fur brush outside diameter by 5% to 20%. The brush fiber can be curved as illustrated in FIG. 5B. The brush fiber can lie from a root of the implantation while the brush fiber itself is substantially linear as illustrated in FIG. 5A. In the present exemplary embodiment, the fur brush with the brush fiber which lies as illustrated in FIG. 5A is used.

The rotation direction of the fur brush 6 and the photoconductor 1 are respectively indicated by arrows shown in FIG. 5A. The fur brush 6 is rotated in a forward direction (a direction opposite the rotation direction of the photoconductor 1) in an opposing area. The fur brush 6 is rotated at a circumferential speed of 110% of the rotation speed of the photoconductor 1. The fur brush 6 is rotated with the brush fiber lying in a direction in which such brush fiber rises with respect to the photoconductor 1 when contacting the photoconductor 1. The cored bar is earthed although voltage is not applied to the fur brush 6. The brush fiber is earthed via the cored bar.

The fur brush 6 is arranged such that a tip of the brush fiber invades the photoconductor 1 by approximately 0.5 mm. Moreover, the fur brush 6 includes conductive brush fiber with a resistance that is adjusted such that, for example, a certain amount of conductive particles, such as carbon, is dispersed in fiber.

In the present exemplary embodiment, the fur brush is set such that an electrical resistance thereof is 10 MΩ) to 300 MΩ) when a voltage of 450 V is applied to the metal rotation shaft of the fur brush in the environment with a temperature of 23° C. and a humidity of 50%. More preferably, the electric resistance is 80 MΩ) to 200 MΩ).

Figures 3A, 3B, 3C, 3D:
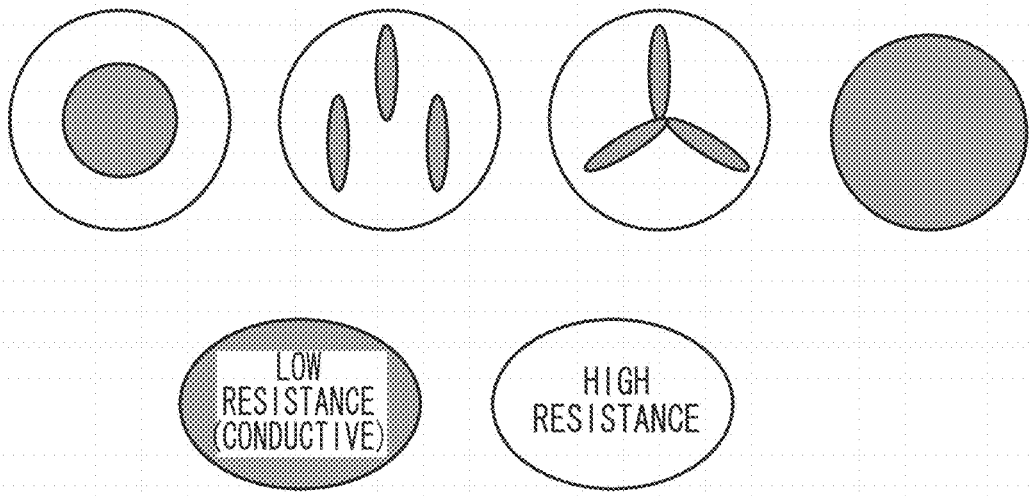
FIGS. 3A, 3B, 3C, and 3D are schematic sectional views each illustrating fur brush fibers according to the exemplary embodiment.

A dispersion state of the conductive material for adjusting the electric resistance of the fur brush is described with reference to FIGS. 3A, 3B, 3C, and 3D which are sectional views of various types of fur brush fibers. In FIGS. 3A through 3D, a black area indicates a portion in which a conductive substance is mixed, whereas a white area indicates a portion having a higher resistance than the black area including the conductive substance. Each of the brush fibers of types illustrated in FIGS. 3A through 3C includes a conductive substance, such as carbon, arranged in a core portion inside the fur brush, and such a core portion is coated with an insulator portion (a high resistance portion, a coating portion) in a sheath manner (hereinafter called a core-sheath type). The insulator portion includes a polyester component as a main component. The brush fiber type illustrated in FIG. 3D includes a conductive substance that is dispersed across the cross section (hereinafter called a whole surface dispersion type). As for the core-sheath type, for example, there are several arrangements of the conductive substance as illustrated in FIGS. 3A through 3C. In the present exemplary embodiment, the core-sheath type brush as illustrated in FIG. 3C is used such that the aforementioned electric resistance is acquired. A reason for the selection of the core-sheath-type fur brush will be described below.

In the present exemplary embodiment, the fiber with a smooth surface is used instead of a surface having a substantially round shape with fine streaks and holes like charcoal. With the smooth-surface fiber, the fur brush uniformly grinds the surface of the photoconductor 1 by contacting the photoconductor 1.

(Relation Between Fur Brush Condition and Surface Layer of Photoconductor)

It is found that an abrasion amount of the surface layer of the photoconductor 1 is affected by a configuration of the fur brush 6, and a detailed description thereof is provided below. In the present exemplary embodiment, as mentioned above, the core-sheath type is employed as a conductive material dispersion state of the fur brush fiber. A result of study on the employment of the core-sheath type is described. For the study, brush fiber materials and fur brushes (1) through (4) were prepared as shown below. In the fur brushes (1) through (4), the conductive material dispersion types illustrated in FIGS. 3A through 3D described above were applied. The fiber brushes (1) through (4) included fibers made of respective materials. In each fiber brush, the fiber in which single fibers having a thickness of 10 denier were bundled was implanted in a base material with a bristle density of 30 kF/inch$^2$ (a bristle density per single fiber). A fiber length (=a brush length) was 4.2 mm which was determined from a difference between an outside diameter of the fur brush and an outside diameter of the cored bar.

(1) made of acrylic, whole surface dispersion type
(2) made of nylon, whole surface dispersion type
(3) made of polyester, whole surface dispersion type
(4) made of polyester, core sheath (C) type Each of these fur brushes 6 was installed in the image forming apparatus. When a certain amount of toner was provided, amounts of toner before and after passing the fur brush 6 were measured. A ratio of the toner amount before and after passing the fur brush 6 was calculated as toner scraping property. Moreover, the toner scraped by the fur brush portion was collected, and external additive component ratios before and after the toner collection were compared as another measurement item based on an intensity ratio of X-ray fluorescence. As result, there was not much difference in the mounts of toner before and after passing the fur brush 6 in any case.

However, external additive component ratios in toner before and after collection of the toner by the fur brushes (1) and (2) differed from those by the fur brushes (3) and (4). In particular, an amount of grinding agent in toner after collection of the toner by each of the fur brushes (3) and (4) was lower than that by each of the fur brushes (1) and (2). That is, it is conceivable that release of the grinding agent within the toner external additive components was facilitated when the fur brush passed, and substances other than the grinding agent were collected by the fur brush. Meanwhile, it is conceivable that uncollected grinding agent reached the cleaning blade 7 positioned on a downstream side of the fur brush 6 to provide a grinding effect in a nip portion of the cleaning blade 7. Accordingly, a fur brush material was preferably polyester to efficiently supply the grinding agent for grinding the surface of the photoconductor 1 to the cleaning blade 7. As a result, polyester was selected as a brush fiber material.

Additional study was conducted on each of the fur brushes (1) and (4) in which amounts of the grinding agent before and after passing the fur brush had differed. On the surface of the photoconductor 1, toner was allowed to fuse with a predetermined area to check a grinding effect on the surface of the photoconductor 1. Then, a certain amount of toner was again supplied to the fur brush, and the photoconductor 1 was idly rotated for two minutes at a rotation speed of 400 mm/sec. The toner fusing areas before and after the idling rotation were compared to check disappearance of the area.

As a result, a toner fusing area after the idling rotation of the fur brush (1) was 72% where a toner fusing area before the idling rotation was 100%. That is, an area in size of 28% of the toner fusing area was ground. As for the fur brush (4), a toner fusing area after the idling rotation was 39%. That is, an area in size of 61% of the toner fusing area was ground. According to these results, it is conceivable that release of the grinding agent was facilitated in the fur brush portion of the fur brush (4) compared to the fur brush (1), and the released grinding agent was conveyed toward the cleaning blade 7 after reapplication to the photoconductor 1 to function as grinding agent.

Similarly, amounts of grinding agents in toners collected by the fur brushes (3) and (4) differed by approximately two times, and a ratio of the grinding agent collected by the fur brush (4) was lower. This indicates that an amount of grinding agent supplied to the cleaning blade 7 when the fur brush (4) was used was approximately double compared to that when the fur brush (3) was used. The fur brush fibers of the fur brushes (3) and (4) were made of substantially the same materials, and only difference was a dispersion state of the conductive material.

Therefore, it seems that there is a relation between the dispersion state of the conductive material and the release behavior of the grinding agent. In a core-sheath-type fur brush, such as the fur brush (4), a sheath portion having a higher resistance than a core portion contacts toner and an external additive component. It is conceivable that the brush fiber surface (the sheath portion) of the fur brush was frictionally charged with a charge, which attracted toner more easily, by contacting and rubbing the photoconductor 1 and toner. Although such a charged state of the sheath portion attracted toner more easily, the charged state of the sheath portion may have repulsed a charge of the grinding agent. Or it is conceivable that, in addition to the charge state of the sheath portion of the fur brush, a physically rubbing operation by the fur brush portion including fur brush formulation resulted in the difference in the amount of the grinding agent.

The above study was conducted on each of the dispersion state types of the conductive materials illustrated in FIGS. 3A, 3B, and 3C. Since the result of each study was similar to one another, the type illustrated in FIG. 3C was selected. Accordingly, a dispersion state of the conductive material is preferably set to a core-sheath type to efficiently supply the grinding agent to the cleaning blade 7.

An abrasion amount of the photoconductor 1 may change if an external additive amount of grinding agent in toner is changed. Such a case was also studied. It is found that the abrasion amount of the photoconductor 1 increased according to parts by mass of the grinding agent in the toner, the grinding agent being to be added.

The abrasion amount of the photoconductor 1 changed depending on formulation of the fur brush 6 other than the dispersion state of the conductive material. Thus, fur brushes with different brush fibers thicknesses, brush lengths, and densities were produced, and a relation between each of the produced fiber brushes and abrasion of the surface layer of the photoconductor 1 was examined.

As a result, a rigidity index related to the abrasion amount of the surface layer of the photoconductor was calculated as a hardness index with respect to the photoconductor 1 from a brush fiber thickness A (denier), a brush fiber bristle density B (kF/inch$^2$), and a brush length C (mm).

In particular, a rigidity index of fur brush was determined by A×B/C. Multiplication of the brush fiber thickness A and the brush fiber bristle density B corresponded to a total rigidity used when the fur brush contacted the photoconductor 1. A length of the brush fiber was changed, and a rigidity was checked. The shorter the brush fiber length, the greater the rigidity. The brush fiber length C was changed, and a degree of influence on the abrasion amount of the surface layer of the photoconductor was examined. A result revealed that the rigidity index (=A×B/C) determined by dividing the product of the brush fiber thickness A and the brush fiber bristle density B by the brush length C became a parameter that correlated with the abrasion amount of the photoconductor 1. Herein, such a parameter is called a fur brush rigidity index. There was a correlation between the fur brush rigidity index determined by the above method and the abrasion amount of the surface layer of the photoconductor 1. The greater the fur brush rigidity index, the harder the fur brush. In other words, the hard fur brush contacted the photoconductor 1. As a matter of course, the greater the fur brush rigidity index, the greater the grinding force to be applied to the surface layer of the photoconductor. Hence, the abrasion amount of the surface layer of the photoconductor 1 was greater.

Meanwhile, the photoconductor contacting the fur brush was also checked. In particular, a photoconductor with a surface layer hardness and an elastic deformation rate D that were changed was prepared. Then, an abrasion amount of the surface layer when the photoconductor rotationally contacted the fur brush was checked under a plurality of conditions. A result shows that the elastic deformation rate of the photoconductor, among some photoconductor parameters, closely correlated with the abrasion amount of the surface layer of the photoconductor.

Accordingly, each of the fur brush rigidity index (=A×B/C) and the photoconductor elastic deformation rate (=D) not only correlates with the abrasion amount of the surface layer of the photoconductor, and also serves as an index indicating a hardness thereof. As mentioned above, the greater the fur brush rigidity, the greater the abrasion amount of the photoconductor surface layer. A ratio of (elastic deformation rate of photoconductor (=D))/(rigidity index of fur brush (=A×B/C)) is calculated from these two parameters. Values for A through D is set such that (elastic deformation rate of photoconductor (=D))/(rigidity index of fur brush (=A×B/C)) is in an appropriate range. This enables an abrasion amount of the surface layer of the photoconductor to be in a range set beforehand.

A lower limit of the abrasion amount of the surface layer of the photoconductor is determined from a standpoint in which toner does not fuse with the photoconductor surface or a poor-quality image due to accumulation of discharge products is not generated. Moreover, an upper limit of the abrasion amount of the surface layer of the photoconductor is determined from a standpoint in which faulty charging due to abrasion of the surface layer does not occur.

Since the abrasion amount of the surface layer of the photoconductor may be affected by grinding agent, the grinding agent may need to be considered as a factor affecting the abrasion amount. Accordingly, a study was conducted on a relation between grinding agent and an abrasion amount of the surface layer of the photoconductor when a core-sheath-type fur brush was used. A photoconductor with an elastic deformation rate that was changed, and a toner in which an external additive amount of grinding agent was changed were prepared. Then, an abrasion amount of the surface layer of the photoconductor was examined while detecting an amount of grinding agent supplied to the cleaning blade by a measurement device.

The study result shows that a degree of influence on the abrasion amount of the surface layer of the photoconductor where parts-by-mass (an additive amount) of external additive of grinding agent relative to 100 parts by mass of toner particles was set to E was considered to be (1+E/10) with respect to the abrasion amount. For example, if E=0.5 pars by mass of strontium titanate fine powder is added as grinding agent, (1+0.5/10)=1.05 is determined. This indicates that abrasion of the photoconductor is accelerated by only a degree of influence of 1.05.

Herein, a method for measuring an inorganic fine particle content (parts by mass) of toner is described. A standard addition method is used to measure a fixed quantity of an inorganic fine particle content of toner. A 3-gram toner is inserted in an aluminum ring having a diameter of 30 mm, and then a 10-ton pressure is applied to produce pellets. Subsequently, a strength of the inorganic fine particles (strength 1) is determined by a wavelength-dispersive X-ray fluorescence spectrometer (XRF). Although measurement conditions can be optimized according to an XRF apparatus to be used, a series of strength measurements are performed under the same conditions. Inorganic fine particles in an amount of 1.0% by mass relative to toner are added to the toner and mixed using a coffee mill. After the inorganic fine particles and the toner are mixed, pellets are produced by a method similar to the above. Then, a strength of the inorganic fine particles is determined (strength 2) by a method similar to the above. Similar operations are performed on a sample in which inorganic fine particles in an amount of 2.0% by mass relative to toner are added and mixed, and a sample in which inorganic fine particles in an amount of 3.0% by mass relative to toner are added and mixed, so that respective strengths of the inorganic fine particles are determined (strength 3, strength 4). With the strengths 1 to 4, an inorganic fine particle content (% by mass) of toner is calculated by the standard addition method.

In the present exemplary embodiment, influence on an abrasion amount of the surface layer of the photoconductor due to conditions other than grinding agent and fur brush formulation needs to be studied. Hence, the following conditions were changed to measure the abrasion amount.

I: A rotation speed of the photoconductor 1 was changed from 400 mm/sec to 300 mm/sec.

II: A primary transfer pressure and a primary transfer high voltage of the primary transfer unit 5 were changed, and a charging potential charged by the charging unit 2 was changed to −800 V (a setting value of an electric current to be applied to a discharging electrode of the corona charging device and a setting value of a grid electrode were changed).

III: A development high voltage of the development unit 4 was changed, and formulation and a setting of the cleaning blade 7 were changed within the range in which cleanability is not impaired.

IV: Various conditions including environment in which the image forming apparatus was placed were changed.

The abrasion amount of the surface layer of the photoconductor was checked for each of the changes I through IV. However, a degree of the influence of each of the changes I through IV with respect to the abrasion amount of the surface layer of the photoconductor was markedly lower than that of the influence of the grinding agent or the fur brush formulation.

Both of the core-sheath-type fur brush rigidity index (=A×B/C) and the photoconductor elastic deformation rate (=D) are indexes related to the hardness as described above, and (D/(A×B/C)) is a parameter that correlates with an abrasion amount of the surface layer of the photoconductor. The influence on the abrasion amount of the surface layer of the photoconductor due to the grinding agent as mentioned above may be considered for the parameter. In such a case, an effect substantially the same as that obtained when the fur brush rigidity index is increased is obtained since it is a factor of the side abrading the photoconductor. Therefore, if the influence on the abrasion amount of the surface layer of the photoconductor due to the grinding agent is considered, a rigidity index of the core-sheath-type fur brush can be expressed by D/(A×B/C)/(1+E/10). On the other hand, in a case where the fur brush of whole surface dispersion type is used, a grinding agent supply amount is halved compared to the fur brush of core-sheath type. Thus, a degree of influence on the abrasion amount of the surface layer of the photoconductor is (1+E/20). Hence, a rigidity index of the fur brush of whole surface dispersion type is expressed by (A×B/C)/(1+E/20).

A rigidity index of core-sheath-type fur brush was studied as follows. A surface state such as surface roughness and an abrasion amount of the surface layer of the photoconductor and generation of poor-quality images when images were formed on 1 million sheets were checked while several values were applied to A through E in a fur brush rigidity index (=A×B/C), a photoconductor elastic deformation rate (=D), and parts by mass of external additive of grinding agent (=E).

The photoconductor elastic deformation rate, parts by mass of external additive of grinding agent, brush fiber thickness of fur brush, and bristle density of brush fiber were respectively set to D=45, E=0.5, A=10 denier, and B=30 kF/inch$^2$. As for the brush fiber length C, three values of C=3.2 mm, 4.2 mm, and 5.2 mm were applied. Each of the fur brushes with the respective brush fiber lengths C was used to form images on 1 million sheets.

The result is shown below.

TABLE 1

Experimental conditions and an example of result in first exemplary embodiment

| EXAMPLE NO. | A FUR BRUSH THICKNESS | B FUR BRUSH BRISTLE DENSITY | C BRUSH LENGTH | D ELASTIC DEFORMATION RATE | E EXTERNAL ADDITIVE AMOUNT | D/(A × B/C)/(1 + E/10) | RESULT |
|---|---|---|---|---|---|---|---|
| 1 | 10.0 | 30.0 | 4.20 | 50.0 | 0.5 | 0.67 | ○○ |
| 2 | 10.0 | 30.0 | 4.20 | 50.0 | 1.0 | 0.64 | ○○ |
| 3 | 10.0 | 30.0 | 4.20 | 50.0 | 1.5 | 0.61 | ○ |
| 4 | 10.0 | 30.0 | 3.20 | 50.0 | 0.5 | 0.51 | X |
| 5 | 10.0 | 30.0 | 5.20 | 50.0 | 0.5 | 0.83 | X |
| 6 | 10.0 | 30.0 | 4.20 | 40.0 | 0.5 | 0.53 | X |
| 7 | 10.0 | 30.0 | 4.20 | 30.0 | 0.5 | 0.40 | XX |
| 8 | 10.0 | 50.0 | 4.20 | 50.0 | 0.5 | 0.40 | XX |
| 9 | 10.0 | 70.0 | 4.20 | 50.0 | 0.5 | 0.29 | XX |
| 10 | 6.0 | 30.0 | 4.20 | 50.0 | 0.5 | 1.11 | XX |
| 11 | 15.0 | 30.0 | 4.20 | 50.0 | 0.5 | 0.44 | XX |
| 12 | 11.3 | 30.0 | 4.20 | 50.0 | 0.5 | 0.59 | X |
| 13 | 11.1 | 30.0 | 4.20 | 50.0 | 0.5 | 0.60 | ○ |
| 14 | 10.4 | 30.0 | 4.20 | 50.0 | 0.5 | 0.64 | ○○ |
| 15 | 9.0 | 30.0 | 4.20 | 50.0 | 0.5 | 0.74 | ○○ |
| 16 | 8.1 | 30.0 | 4.20 | 50.0 | 0.5 | 0.82 | ○ |

TABLE 1-continued

Experimental conditions and an example of result in first exemplary embodiment

| EXAMPLE NO. | A FUR BRUSH THICKNESS | B FUR BRUSH BRISTLE DENSITY | C BRUSH LENGTH | D ELASTIC DEFORMATION RATE | E EXTERNAL ADDITIVE AMOUNT | D/(A × B/C)/(1 + E/10) | RESULT |
|---|---|---|---|---|---|---|---|
| 17 | 8.0 | 30.0 | 4.20 | 50.0 | 0.5 | 0.83 | X |
| 18 | 10.0 | 34.0 | 4.20 | 50.0 | 0.5 | 0.59 | X |
| 19 | 10.0 | 33.3 | 4.20 | 50.0 | 0.5 | 0.60 | ○ |
| 20 | 10.0 | 31.3 | 4.20 | 50.0 | 0.5 | 0.64 | ○○ |
| 21 | 10.0 | 27.0 | 4.20 | 50.0 | 0.5 | 0.74 | ○○ |
| 22 | 10.0 | 24.5 | 4.20 | 50.0 | 0.5 | 0.82 | ○ |
| 23 | 10.0 | 24.0 | 4.20 | 50.0 | 0.5 | 0.83 | X |
| 24 | 10.0 | 30.0 | 3.70 | 50.0 | 0.5 | 0.59 | X |
| 25 | 10.0 | 30.0 | 3.80 | 50.0 | 0.5 | 0.60 | ○ |
| 26 | 10.0 | 30.0 | 4.05 | 50.0 | 0.5 | 0.64 | ○○ |
| 27 | 10.0 | 30.0 | 4.65 | 50.0 | 0.5 | 0.74 | ○○ |
| 28 | 10.0 | 30.0 | 5.15 | 50.0 | 0.5 | 0.82 | ○ |
| 29 | 10.0 | 30.0 | 5.25 | 50.0 | 0.5 | 0.83 | X |
| 30 | 10.0 | 30.0 | 4.20 | 44.0 | 0.5 | 0.59 | X |
| 31 | 10.0 | 30.0 | 4.20 | 45.0 | 0.5 | 0.60 | ○ |
| 32 | 10.0 | 30.0 | 4.20 | 48.0 | 0.5 | 0.64 | ○○ |
| 33 | 10.0 | 30.0 | 4.20 | 55.5 | 0.5 | 0.74 | ○○ |
| 34 | 10.0 | 30.0 | 4.20 | 61.5 | 0.5 | 0.82 | ○ |
| 35 | 10.0 | 30.0 | 4.20 | 62.5 | 0.5 | 0.83 | X |

In Example No. 4, a brush length was 3.2 mm, and a fur brush rigidity index was 0.51. In this Example, since the fur brush rigidity was high relative to the elastic deformation rate of the photoconductor, an abrasion amount of the surface layer of the photoconductor increased after images were formed on approximately 480,000 sheets. As a result, flaws were generated on the photoconductor, and poor-quality images were generated due to the flaws.

In Example No. 5, a brush length was 5.2 mm, and a fur brush rigidity index was 0.83. In this Example, since the fur brush rigidity was low relative to the elastic deformation rate of the photoconductor, the capability of the fur brush for rubbing the surface layer of the photoconductor was degraded. As a result, poor-quality images were generated due to accumulation of discharge products after images were formed on approximately 380,000 sheets, and toner fused with the photoconductor surface after images were formed on approximately 410,000 sheets.

Moreover, similar to the above Examples, a change in each of the conditions A through E was studied. A result column in Table 1 indicates the presence or absence of poor-quality image when one million sheets with images having an image ratio of 10% were fed by the image forming apparatus. In the result column, a symbol ○ indicates that a poor-quality image was not generated during the image formation on 1 million sheets, whereas a symbol x indicates that toner fusion bonding occurred or a poor-quality image was generated due to accumulation of discharge products before images were formed on 1 million sheets or a poor-quality image was generated by flaws on the surface of the photoconductor due to a large abrasion amount. In the result column, a symbol xx indicates that a poor-quality image was generated before images were formed on 500,000 sheets or less, whereas a symbol ○○ indicates that images were formed on 1.3 million sheets or more with the lifespan of the photoconductor.

As a result, it is found that the lifespan of the photoconductor could be prolonged if the conditions of A through E were set such that the fur brush rigidity index was 0.6 or more and 0.82 or less. More preferably, the lifespan of the photoconductor could be prolonged more if the conditions of A through E were set such that the fur brush rigidity index was 0.64 or more and 0.74 or less.

Figure 9:
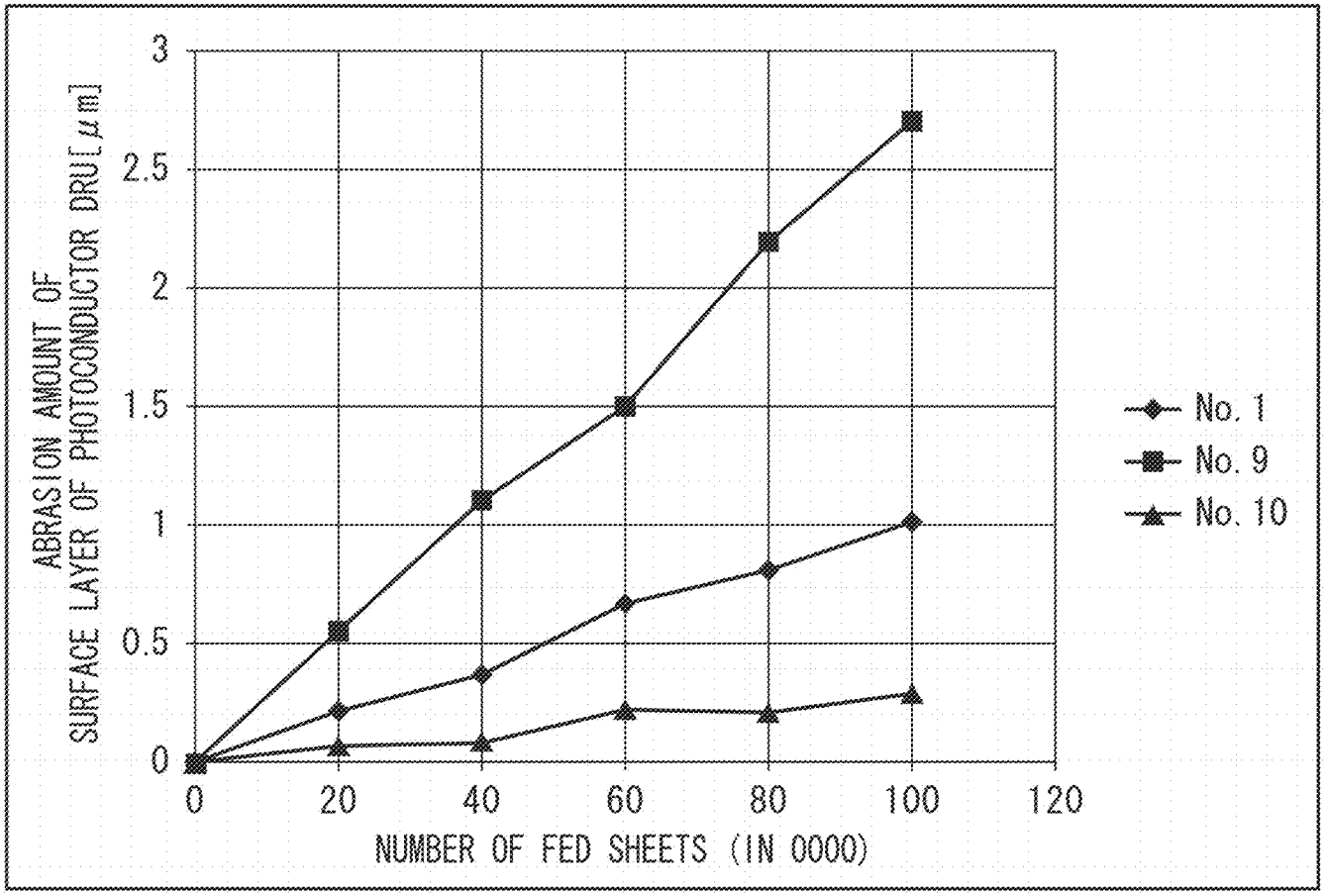
FIG. 9 is a graph illustrating a change in abrasion amount of a surface layer of a photoconductor according to the first exemplary embodiment.

Meanwhile, abrasion of film thickness of the surface layer of the photoconductor was measured every 100,000 sheets during the above study in which the images were formed on 1 million sheets. A change in abrasion amount is described using Examples No. 1, No. 9, and No. 10 that are distinctive among the study results illustrated in Table 1. FIG. 9 is a graph illustrating a change in abrasion amount of the surface layer of the photoconductor when the study was performed. In Example No. 1 as illustrated in FIG. 9, when 1 million sheets were fed, an abrasion amount was approximately 1.0 μm and an average abrasion amount per 100,000 sheets was approximately 0.1 μm. In Example No. 10, a poor-quality image was generated due to accumulation of discharge products, and fusing of toner with the photoconductor occurred. In Example No. 10 as illustrated in FIG. 9, when 1 million sheets were fed, an abrasion amount was approximately 0.3 μm and an average abrasion amount per 100,000 sheets was approximately 0.03 μm. It is conceivable that the average abrasion amount per 100,000 sheets of approximately 0.03 μm was too low to abrade the discharge products adhering to the surface of the photoconductor, and thus image deletion occurred. Consequently, the poor-quality image due to accumulation of discharge products was generated, or the fusion bonding occurred. Moreover, since an external additive component and a toner component were likely to remain adhering to the surface of the photoconductor, the fusion bonding with the photoconductor surface occurred. In Example No. 9 as illustrated in FIG. 9, when 1 million sheets were fed, an abrasion amount was approximately 2.7 μm and an average abrasion amount per 100,000 sheets was approximately 0.27 μm. In contrast to Example No. 10, the average abrasion amount per 100,000 sheets of approximately 0.27 μm and an abrasion rate of the surface layer of the photoconductor were excessively high. This generated flaws on the surface layer of the photoconductor before the images were formed on 1 million sheets.

Based on these results, it is found that there was a correlation between (D/(A×B/C))/(1+E/10) and the actual abrasion amount of the surface layer of the photoconductor. Accordingly, if the conditions of A through E are set such that the rigidity index was 0.6 or more and 0.82 or less, the abrasion amount of the photoconductor can be set in a predetermined range. Moreover, the conditions of A through E can be set such that the rigidity index is 0.64 or more and 0.74 or less, whereby it becomes possible to optimize an abrasion amount of the photoconductor and further prolong the lifespan of the photoconductor.

Accordingly, the relation between the fur brush rigidity index (=A×B/C), the photoconductor elastic deformation rate (=D), and parts by mass of external additive of grinding agent (=E) has been focused, and the conditions of A through E are set such that the rigidity index as a relational expression of such a relation is set to 0.6 or more and 0.82 or less. More preferably, the rigidity index is set to 0.64 or more and 0.74 or less. As a result, problems, such as short lifespan of the photoconductor, a poor-quality image due to accumulation of discharge products, and toner fusion can be prevented.

Second Exemplary Embodiment

A configuration of an image forming apparatus of the present exemplary embodiment is similar to that of the first exemplary embodiment. In the present exemplary embodiment, a drum heater 300 is disposed inside a photoconductor 1. The drum heater 300 controls temperature of a surface layer of the photoconductor 1. Hereinafter, the drum heater 300 is described.

(Drum Heater)

Figure 8:
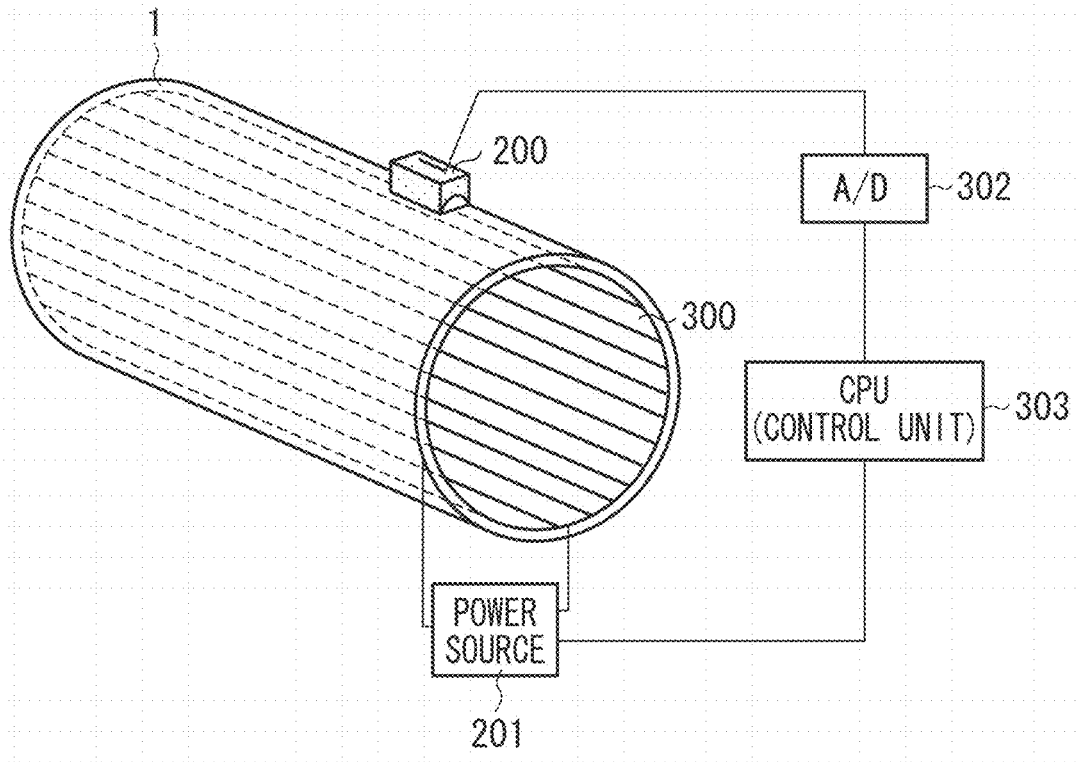
FIG. 8 is a schematic diagram illustrating a photoconductor heater according to a second exemplary embodiment of the present invention.

Next, the drum heater 300 according to the present exemplary embodiment is described with reference to FIG. 8. A planar heat generator in which a heat generation coil is arranged on a sheet made of polycarbonate is used as the drum heater 300 serving as a heating member of an image bearing member. The planer heat generator is disposed inside the photoconductor 1 in a state that the planer generator is set in cylindrical shape. As illustrated in FIG. 8, the planer heat generator is attached to the photoconductor 1. That is, the drum heater 300 is attached along the inside of the photoconductor 1. The planer heat generator generates heat by receiving voltage from a heater power source 201, thereby heating the photoconductor 1. Herein, a thermistor 200 detects temperature information of a surface of the photoconductor 1, and a central processing unit (CPU) 303 as a control unit adjusts temperature of the surface of the photoconductor 1. A supply line from the heater power source 201 and a line from the CPU 303 to the thermistor 200 are directly connected such that the photoconductor 1 and the drum heater 300 are rotatable. In practice, the connection can be made via a slip ring. A description of the slip ring is omitted. The drum heater 300 consumes a power of 60 W.

The use of such a drum heater 300 can control a surface temperature of the photoconductor 1 to 35° C. Such temperature control reduces moisture in the surface of the photoconductor 1, so that influence of discharge products generated by a corona charging device or a primary transfer unit can be reduced. Moreover, since a cleaning blade 7 being in contact with the photoconductor 1 is also heated by the drum heater 300, the cleaning blade 7 is less likely to be influenced by the environment in which the image forming apparatus is placed. Hence, cleanability of the cleaning blade 7 is enhanced. The influence caused by changes in temperature is small if polyester is used as a material of fur brush, compared to nylon or acryl.

A rigidity index of a core-sheath-type fur brush was changed in a state that the drum heater 300 was present. Such changes in rigidity index were studied as similar to the first exemplary embodiment.

TABLE 2

Experimental conditions and an example of result in second exemplary embodiment

| D/(A × B/C)/ (1 + E/10) | WITHOUT DRUM HEATER | WITH DRUM HEATER |
|---|---|---|
| 0.58 | x | x |
| 0.59 | x | x |
| 0.6 | ○ | ○ |
| 0.61 | ○ | ○ |
| 0.74 | ○○ | ○○ |
| 0.75 | ○ | ○○ |
| 0.76 | ○ | ○○ |
| 0.77 | ○ | ○○ |
| 0.78 | ○ | ○ |
| 0.82 | ○ | ○ |
| 0.83 | x | ○ |
| 0.84 | x | ○ |
| 0.85 | x | ○ |
| 0.86 | x | x |

As a result, since moisture in the surface of the photoconductor 1 was evaporated by the drum heater 300, a poor-quality image due to accumulation of discharge products did not tend to be generated. Hence, a range of numerical values of the upper limit side was shifted to a larger side. When the drum heater 300 was not present, the rigidity index of (D/(A×B/C))/(1+E/10) was preferably 0.6 or more and 0.82 or less, more preferably 0.64 or more and 0.74 or less. However, it is found that when the drum heater 300 was present, the rigidity index was preferably 0.6 or more and 0.85 or less, more preferably 0.64 or more and 0.77 or less.

A rigidity index of a whole-surface-dispersion-type fur brush was changed in a state that the drum heater 300 was present. Such changes in rigidity index were studied as similar to the first exemplary embodiment.

TABLE 3

Experimental conditions and an example of result in second exemplary embodiment

| D/(A × B/C)/ (1 + E/20) | WITHOUT DRUM HEATER | WITH DRUM HEATER |
|---|---|---|
| 0.58 | x | x |
| 0.59 | x | x |
| 0.6 | ○ | ○ |
| 0.61 | ○ | ○ |
| 0.74 | ○○ | ○○ |
| 0.75 | ○ | ○○ |
| 0.76 | ○ | ○○ |
| 0.77 | ○ | ○○ |
| 0.78 | ○ | ○ |
| 0.82 | ○ | ○ |
| 0.83 | x | ○ |
| 0.84 | x | ○ |
| 0.85 | x | ○ |
| 0.86 | x | x |

As a result, a range of numerical values of the upper limit side was shifted to a larger side as similar to the study of the rigidity index of core-sheath-type fur brush. When the drum heater 300 was not present, the rigidity index of (D/(A×B/

C))/(1+E/20) was preferably 0.6 or more and 0.82 or less, more preferably 0.64 or more and 0.74 or less. However, it is found that when the drum heater 300 was present, the rigidity index was preferably 0.6 or more and 0.85 or less, more preferably 0.64 or more and 0.77 or less.

Accordingly, in the image forming apparatus including the heating member for heating the photoconductor 1, the relation between the fur brush rigidity index (=A× B/C), the photoconductor elastic deformation rate (=D), and parts by mass of external additive of grinding agent (=E) has been focused. Moreover, the conditions of A through E are set such that the rigidity index as a relational expression of such a relation is set to 0.6 or more and 0.85 or less, more preferably 0.64 or more and 0.77 or less. As a result, problems such as short lifespan of the photoconductor, a poor-quality image due to accumulation of discharge products, and toner fusion can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-162990, filed Aug. 20, 2015, which is hereby incorporated by reference herein in its entirety.

What is claimed is:

1. An image forming apparatus comprising:

a rotatable photoconductor configured to bear a toner image;

an image forming unit configured to form the toner image on the photoconductor with toner, the toner comprising inorganic fine particles as an external additive;

a cleaning blade configured to clean toner remaining on the photoconductor in a cleaning position; and a brush that is disposed adjacent to and upstream of the cleaning position with respect to a rotation direction of the photoconductor, the brush including fibers, each of the fibers comprising a conductive core portion and a coating portion that covers the core portion, wherein an elastic deformation rate of the photoconductor, an additive amount of the inorganic fine particles, and the fibers of the brush satisfy the following relationship:

$$0.6 \leq (D/(A \times B/C))/(1+E/10) \leq 0.82,$$

where A (denier) is a thickness of the fibers of the brush, B (kF/inch$^2$) is a bristle density of the fibers of the brush, C (mm) is a length of the fibers of the brush, D (%) is an elastic deformation rate of the photoconductor obtained from a hardness test conducted using a Vickers diamond pyramid indenter at a temperature of 23° C. and a humidity of 50%, and E (parts) is the additive amount of the inorganic fine particles relative to 100 parts by mass of toner particles.

2. The image forming apparatus according to claim 1, wherein the elastic deformation rate of the photoconductor, the additive amount of the inorganic fine particles, and the fibers of the brush satisfy the following relationship:

$$0.64 \leq (D/(A \times B/C))/(1+E/10) \leq 0.74.$$

3. The image forming apparatus according to claim 1, wherein the inorganic fine particles include primary particles with an average particle diameter of 30 nm to 300 nm, and have a cubic particle shape and/or a cuboid particle shape and a perovskite structure.

4. The image forming apparatus according to claim 1, further comprising a heating device configured to heat the photoconductor.

5. The image forming apparatus according to claim 1, wherein the cleaning blade includes urethane rubber with a modulus of repulsion elasticity in a range of 15% to 60%.

6. The image forming apparatus according to claim 1, wherein a surface of the photoconductor is hardened by an electron beam.

7. An image forming apparatus comprising:

a rotatable photoconductor configured to bear a toner image;

an image forming unit configured to form the toner image on the photoconductor with toner, the toner comprising inorganic fine particles as an external additive;

a cleaning blade configured to clean toner remaining on the photoconductor in a cleaning position; and a brush that is disposed adjacent to and upstream of the cleaning position with respect to a rotation direction of the photoconductor, the brush comprising fibers, each of the fibers containing resin material, including a conductive material dispersed therein, wherein an elastic deformation rate of the photoconductor, an additive amount of the inorganic fine particles, and the fibers of the brush satisfy the following relationship:

$$0.6 \leq (D/(A \times B/C))/(1+E/20) \leq 0.82,$$

where A (denier) is a thickness of the fibers of the brush, B (kF/inch$^2$) is a bristle density of the fibers of the brush, C (mm) is a length of the fibers of the brush, D (%) is an elastic deformation rate of the photoconductor obtained from a hardness test conducted using a Vickers diamond pyramid indenter at a temperature of 23° C. and a humidity of 50%, and E (parts) is the additive amount of the inorganic fine particles relative to 100 parts by mass of toner particles.

8. The image forming apparatus according to claim 7, wherein the elastic deformation rate of the photoconductor, the additive amount of the inorganic fine particles, and the fibers of the brush satisfy the following relationship:

$$0.64 \leq (D/(A \times B/C))/(1+E/20) \leq 0.74.$$

9. The image forming apparatus according to claim 7, wherein the inorganic fine particles include primary particles with an average particle diameter of 30 nm to 300 nm, and have a cubic particle shape and/or a cuboid particle shape and a perovskite structure.

10. The image forming apparatus according to claim 7, further comprising a heating device configured to heat the photoconductor.

11. The image forming apparatus according to claim 7, wherein the cleaning blade includes urethane rubber with a modulus of repulsion elasticity in a range of 15% to 60%.

12. The image forming apparatus according to claim 7, wherein a surface of the photoconductor is hardened by an electron beam.

13. An image forming apparatus comprising:

a rotatable photoconductor configured to bear a toner image;

a heating device configured to heat the photoconductor;

an image forming unit configured to form the toner image on the photoconductor with toner, the toner comprising inorganic fine particles as an external additive;

a cleaning blade configured to clean toner remaining on the photoconductor in a cleaning position; and a brush that is disposed adjacent to and upstream of the cleaning position in a rotation direction of the photoconductor, the brush including fibers, each of the fibers comprising a conductive core portion, and a coating portion that covers the core portion, wherein an elastic deformation rate of the photoconductor, an additive amount of the inorganic fine particles, and the fibers of the brush satisfy the following relationship:

$$0.6 \leq (D/(A \times B/C))/(1+E/10) \leq 0.85,$$

where A (denier) is a thickness of the fibers of the brush, B (kF/inch$^2$) is a bristle density of the fibers of the brush, C (mm) is a length of the fibers of the brush, D (%) is an elastic deformation rate of the photoconductor obtained from a hardness test conducted using a Vickers diamond pyramid indenter at a temperature of 23° C. and a humidity of 50%, and E (parts) is the additive amount of the inorganic fine particles relative to 100 parts by mass of toner particles.

14. The image forming apparatus according to claim 13, wherein the elastic deformation rate of the photoconductor, the additive amount of the inorganic fine particles, and the fibers of the brush satisfy the following relationship:

$$0.64 \leq (D/(A \times B/C))/(1+E/10) \leq 0.77.$$

15. The image forming apparatus according to claim 13, wherein the inorganic fine particles include primary particles with an average particle diameter of 30 nm to 300 nm, and have a cubic particle shape and/or a cuboid particle shape and a perovskite structure.

16. The image forming apparatus according to claim 13, wherein the cleaning blade includes urethane rubber with a modulus of repulsion elasticity in a range of 15% to 60%.

17. The image forming apparatus according to claim 13, wherein a surface of the photoconductor is hardened by an electron beam.

18. An image forming apparatus comprising:

a rotatable photoconductor configured to bear a toner image;

a heating device configured to heat the photoconductor;

an image forming unit configured to form the toner image on the photoconductor with toner, the toner comprising inorganic fine particles as an external additive;

a cleaning blade configured to clean toner remaining on the photoconductor in a cleaning position; and a brush that is disposed adjacent to and upstream of the cleaning position with respect to a rotation direction of the photoconductor, the brush comprising fibers, each of the fibers containing resin material including a conductive material dispersed therein, wherein an elastic deformation rate of the photoconductor, an additive amount of the inorganic fine particles, and the fibers of the brush satisfy the following relationship:

$$0.6 \leq (D/(A \times B/C))/(1+E/20) \leq 0.85,$$

where A (denier) is a thickness of the fibers of the brush, B (kF/inch$^2$) is a bristle density of the fibers of the brush, C (mm) is a length of the fibers of the brush, D (%) is an elastic deformation rate of the photoconductor obtained from a hardness test conducted using a Vickers diamond pyramid indenter at a temperature of 23° C. and a humidity of 50%, and E (parts) is the additive amount of the inorganic fine particles relative to 100 parts by mass of toner particles.

19. The image forming apparatus according to claim 18, wherein the elastic deformation rate of the photoconductor, the additive amount of the inorganic fine particles, and the fibers of the brush satisfy the following relationship:

$$0.64 \leq (D/(A \times B/C))/(1+E/20) \leq 0.77.$$

20. The image forming apparatus according to claim 18, wherein the inorganic fine particles include primary particles with an average particle diameter of 30 nm to 300 nm, and have a cubic particle shape and/or a cuboid particle shape and a perovskite structure.

21. The image forming apparatus according to claim 18, wherein the cleaning blade includes urethane rubber with a modulus of repulsion elasticity in a range of 15% to 60%.

22. The image forming apparatus according to claim 18, wherein a surface of the photoconductor is hardened by an electron beam.

23. The image forming apparatus according to claim 1, wherein the fibers contain polyester resin.

24. The image forming apparatus according to claim 7, wherein the fibers contain polyester resin.

25. The image forming apparatus according to claim 13, wherein the fibers contain polyester resin.

26. The image forming apparatus according to claim 18, wherein the fibers contain polyester resin.

* * * * *